United States Patent [19]

Kapoor

[11] 4,227,458

[45] Oct. 14, 1980

[54] INK FOUNTAIN DRIVE MECHANISM

[75] Inventor: Vinod Kapoor, Bayside, N.Y.

[73] Assignee: Butler Greenwich Inc., Greenwich, Conn.

[21] Appl. No.: 910,815

[22] Filed: May 30, 1978

[51] Int. Cl.[3] ..... B41F 31/04; B41F 31/06

[52] U.S. Cl. ..... 101/350; 192/415; 101/365

[58] Field of Search ..... 101/350, 351, 363, 364, 101/DIG. 6, 204, 49, 207, 208, 210, 148, 315, 321, 326, 330, 340, 344, 347, 355, 356, 360, 361, 357, 51; 192/41 S, 33 C, 26, 24, 12 BA

[56] References Cited

U.S. PATENT DOCUMENTS

| | | | |
|---|---|---|---|
| 956,316 | 4/1910 | Droitcour | 101/363 |
| 2,425,218 | 8/1947 | Worthington | 101/248 |
| 3,926,286 | 12/1975 | Johnson | 192/41 S |

FOREIGN PATENT DOCUMENTS

| | | | |
|---|---|---|---|
| 81988 | 10/1956 | Denmark | 101/350 |
| 1250452 | 9/1967 | Fed. Rep. of Germany | 101/350 |
| 27181 | of 1906 | United Kingdom | 101/350 |

OTHER PUBLICATIONS

Wrap Spring Clutches & Brakes, publication P-16, Warner Electric Brake & Clutch Co., Beloit, Wi.

*Primary Examiner*—J. Reed Fisher

*Attorney, Agent, or Firm*—Cesari and McKenna

[57] ABSTRACT

An ink fountain for a printing press includes a fountain roller that is driven intermittently by a variable stroke drive mechanism which is actuated by an eccentric. However, instead of varying the length of linkages between the eccentric and the roller to obtain the variable stroke capability, the present mechanism employs constant length linkages coupled to the fountain roller by way of a wrap-spring overrunning clutch. A stop plate adjustably positioned by a hand wheel is arranged to stop the rotation of the clutch sleeve after it has rotated through a selected angle thereby to disengage the clutch. Thus, as the eccentric rotates, it oscillates the clutch input drum through a constant angle. However, the clutch output drum and therefore the fountain roller are advanced through a stroke angle that is continuously variable depending upon the adjustment of the hand wheel.

12 Claims, 6 Drawing Figures

INK FOUNTAIN DRIVE MECHANISM

BACKGROUND OF THE INVENTION

This invention relates to an ink fountain for a printing press. It relates more particularly to an improved mechanism for driving the fountain roller in an ink fountain.

BACKGROUND OF THE INVENTION

An ink fountain is basically a dispenser of ink used to coat ultimately the printing roller in a printing press. The fountain includes a tray-like container whose bottom wall is formed by a rotatable fountain roller and an inclined fountain blade the lower edge of which bears against the surface of the roller. A supply of ink is maintained in the space between the fountain roller and the blade and when the roller is rotated in the direction that advances the immersed segment of the roller toward the blade edge, a film of ink is applied to the roller surface. Provision is made for varying the pressure of the blade against the roller to control the thickness of the ink film deposited on the roller.

The ink on the fountain roller is transferred to a so-called ductor roller which, in turn, applies the ink to a distributor roller. Actually, the ducter roller oscillates back and forth between the fountain roller and the distributor roller so that it first picks up ink from the former and then deposits it on the latter. The ink on the distributor roller is thereupon applied via a train of vibrator and distributor rollers to the printing roller as a very thin, uniform film suitable for printing.

Normally the fountain roller in an ink fountain is advanced intermittently rather than continuously because the stop-start movements of the roller tends to agitate the ink in the fountain reservoir, thereby minimizing pigment settling, surface agglomerations and the like. This helps to assure that the ink film applied to the fountain roller by the fountain blade is reasonably uniform along the entire length of the roller. Consequently, the mechanisms used to advance the fountain roller invariably comprise a reciprocating or eccentric-type drive coupled to the fountain roller by way of one or more one-way clutches, usually of the sprag type.

Due to the nature of the printing process, it is essential that the size or amount of that incremental advance or stroke of the fountain roller be controllable. This is because as the stroke is increased, the fountain blade applies ink to a greater sector of the fountain roller so that a greater amount of ink is passed on by the various rollers in the roller train to the printing roller. Conversely, if the stroke of the fountain roller is smaller, less ink is ultimately transferred to the printing roller. Because of that variable stroke requirement, the mechanisms used heretofore to drive the fountain roller have been quite complex and expensive. They rely on elaborate moving linkages to vary the length of the lever arm connected to the clutch that unidirectionally advances the fountain roller. Some of those linkage include rack and pinion mechanisms, others have complicated pin and slot arrangements. While those prior drive mechanisms perform their function satisfactorily, being composed of so many separate parts, they occupy a considerable amount of space, they are relatively difficult to assemble and align properly, they are overly expensive and they are prone to wear which increases the overall maintenance cost and down time of the press as a whole.

SUMMARY OF THE INVENTION

Accordingly, the present invention aims to provide an improved drive mechanism for an ink fountain used in a printing press.

Another object of the invention is to provide an ink fountain drive mechanism composed of a relatively few separate parts.

Still another object of the invention is to provide a mechanism of this type which is relatively easy and inexpensive to install and to maintain.

A further object of the invention is to provide an ink fountain drive mechanism having a precisely controlled variable stroke capability.

Yet another object of the invention is to provide such a mechanism which is easily adjustable using an operator-accessible hand wheel.

Still another object of the invention is to provide a variable stroke drive mechanism for an ink fountain roller whose stroke is calibrated readily with the hand wheel adjustment.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my ink fountain employs a variable stroke drive mechanism operated from an eccentric or crank which advances the fountain roller intermittently, yet all of whose parts including lever and crank arms and connecting linkages have constant lengths. Consequently, the mechanism of this invention does not require any rack and pinion arrangements, slides, pin and slot connections, or other such moving linkages to achieve its variable stroke capability. Rather my drive mechanism utilizes a single wrap-spring overrunning clutch whose output drum is connected to the fountain roller axle. The clutch input drum is connected by a fixed-length lever arm and a single rigid connecting rod to the usual driven eccentric. Rotation of the eccentric oscillates or reciprocates the clutch input drum and sleeve through a constant angle whose value depends upon the lengths of the crank and lever arms. The angular advance or stroke of the clutch output drum on the other hand, is continuously variable, the adjustment being made by a calibrated hand wheel that is readily accessible to the press operator.

The hand wheel controls the position of a stop plate adjustably mounted adjacent the clutch. The stop plate is arranged to stop the rotation of the clutch sleeve and thereby disengage the clutch when the clutch input drum and sleeve have advanced through a selected stroke angle. Consequently, even though the clutch input drum may continue its advance as lost motion, the clutch output drum, being decoupled, stops at the precise angular orientation determined by the setting of the hand wheel.

Thus the present drive mechanism replaces the sliding linkages, pinions, racks and multiple clutch arrangements found in prior drives with a single wrap-spring clutch driven by a fixed-length lever arm and connecting rod leading to the usual driven eccentric all of whose connections are of the rotary type which suffer minimum wear. The only other component of my mechanism is a normally fixed, but adjustable, stop plate assembly that disengages the clutch when the clutch output and fountain roller have advanced through the selected stroke angle.

As a result, my drive mechanism is quite compact and easily installed. By the same token, since the mechanism is composed of a relatively few sturdy components, the ink fountain as a whole is less expensive to make and suffers less down time than prior conventional ink fountains of this general type.

BRIEF DESCRIPTION OF THE DRAWINGS

For a fuller understanding of the nature and objects of the invention, reference should be had to the following detailed description taken in connection with the accompanying drawings in which.

DESCRIPTION OF THE PREFERRED EMBODIMENT

Figure 1:
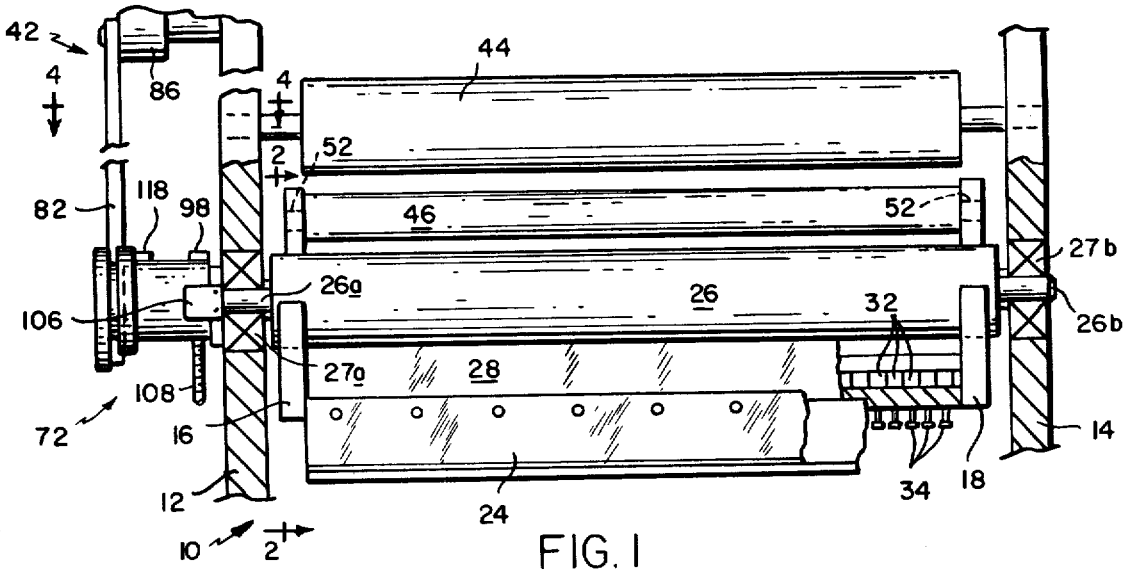
FIG. 1 is a top plan view with parts in section illustrating an ink fountain made in accordance with this invention.
Figure 2:
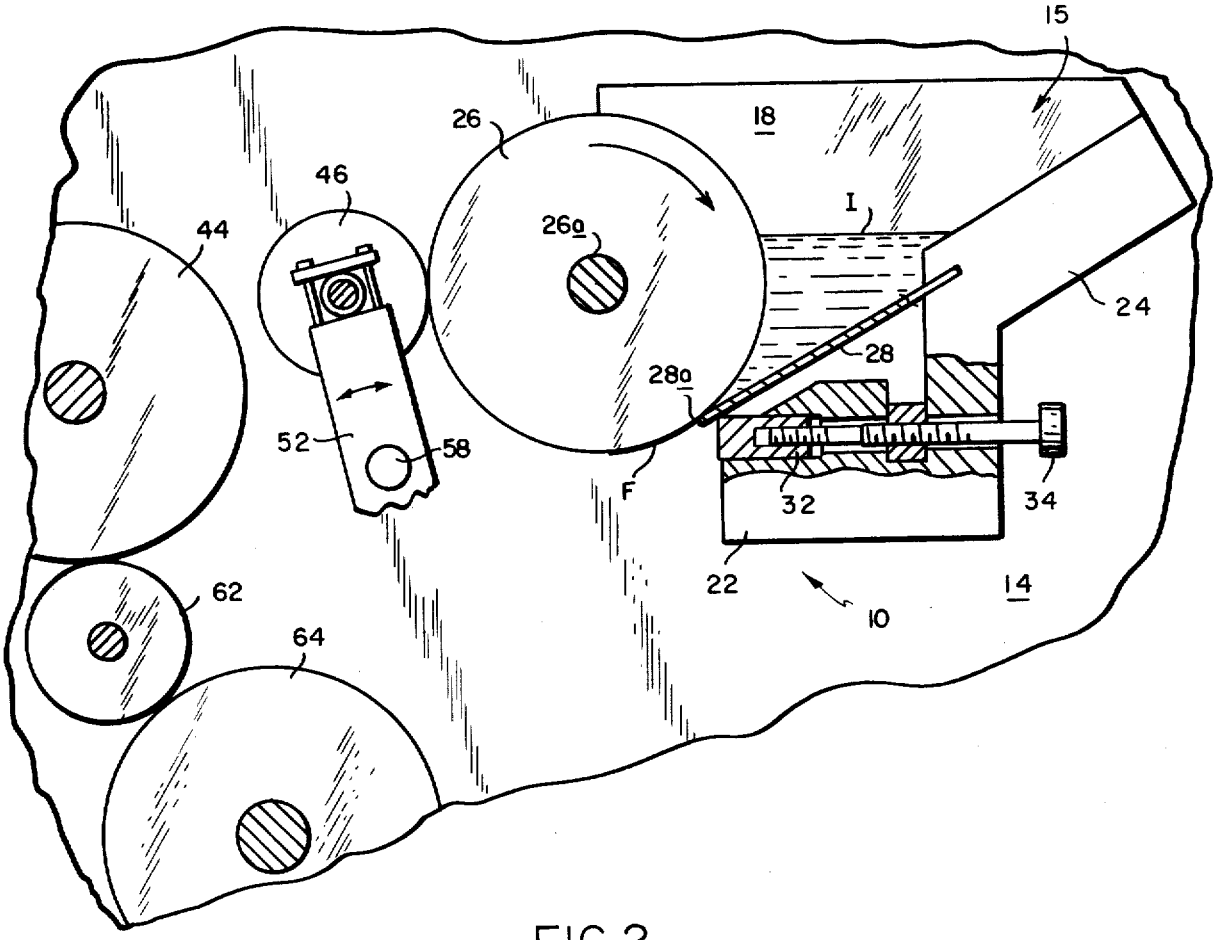
FIG. 2 is a sectional view along line 2—2 of FIG. 1 on a larger scale.

Referring now to FIGS. 1 and 2 of the drawings, the ink fountain indicated generally at 10 is supported by the printing press side plates 12 and 14. Usually an ink fountain is located near the top and near the bottom of the press to dispense ink destined for one or the other of the two printing rollers often found in presses of this general type. The fountain 10 specifically illustrated herein happens to be located near the top of the press.

The fountain comprises an ink reservoir or tray shown generally at 15 comprising a pair of end walls 16 and 18, a bottom wall 22 and inclined side wall 24. A fountain roller 26 is positioned adjacent bottom wall 22. Its shafts 26*a* and 26*b* are rotatively mounted in bearings 27*a* and 27*b* supported by the press side plates 12 and 14. Further a fountain blade 28 which is basically an extension of the inclined tray sidewall 24 projects down toward roller 26 where its lower edge 28*a* engages the underside of roller 26 as best seen in FIG. 2. A quantity of ink I is maintained in the fountain tray 15 in the space between the roller 26 and the blade 28. When the fountain roller 26 is rotated in the direction indicated by the arrow, an ink film is coated onto the surface of the roller as shown at F in FIG. 2.

Also as is conventional in fountains of this general type, means are provided for biasing the blade 28 against the roller 26 with a selective amount of force so as to vary the thickness of the ink film F applied to the roller. In the illustrated fountain, such means comprise a longitudinal set of keys 32 individually slidably mounted in the bottom wall 22 along the entire length of blade 28. Each key can be urged against a segment of blade 28 with a selected amount of force as determined by the adjustment of a set screw 34 threadedly mounted in bottom wall 22 and bearing against a key 32. As described in detail, for example, in U.S. Pat. No. 3,559,573, the pressure of the blade against the fountain roller 26 can be precisely controlled along the entire length of the blade by accurately setting the screws 34. In this way, an ink film F can be applied to the fountain roller which has relatively uniform thickness and consistency along the entire length of the roller.

The fountain roller 26 is advanced intermittently in the direction indicated by the arrow by a drive mechanism indicated generally at 42 in FIG. 1. As the roller 26 turns, the ink film F coated thereon is transferred to a distributor roller 44 rotatively mounted between press walls 12 and 14 by way of a ductor roller 46. Roller 46 is rotatively suspended between a pair of arms 52, 52 secured to an axle 56 pivotally mounted between press walls 12 and 14. The arms 52 and the ductor roller 46 can be swung between fountain roller 26 and distributor roller 44 so that roller 44 alternately engages rollers 26 and 44.

The mechanism for swinging or oscillating roller 46 is of conventional design and therefore will not be detailed here. Suffice it to say that when fountain roller 26 is advanced, ductor roller 46 is brought into contact with that roller as shown in FIG. 2 and when roller 26 pauses, roller 46 is swung into engagement with the distributor roller 44. Thus the back and forth movement of the ductor roller transfers the ink film F from roller 26 to roller 44.

From roller 44 the ink is applied to additional distributing and vibrating rollers in the roller train leading down to the printing roller, only two of these being indicated at 62 and 64 in FIG. 2. All the while, the ink film is made thinner and more uniform so that it has the proper thickness and consistency when it is ultimately transferred to the printing roller.

Figure 3:
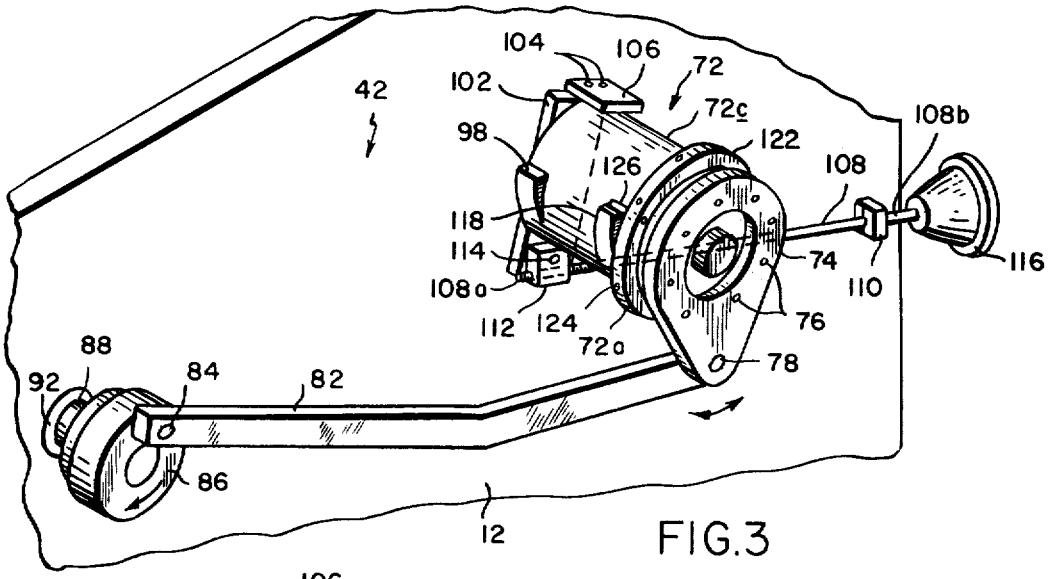
FIG. 3 is an isometric view showing the ink fountain drive mechanism in greater detail.
Figure 4:
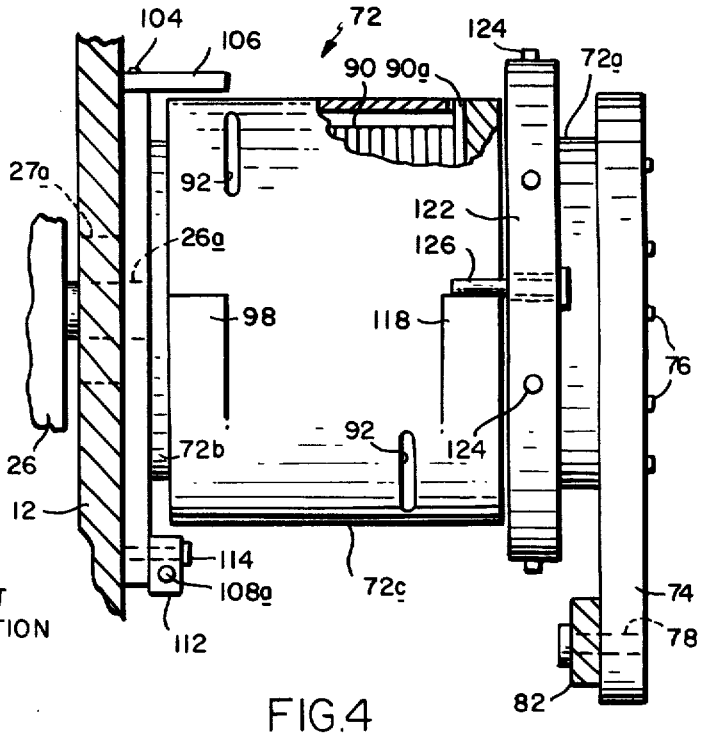
FIG. 4 is a view in elevation along line 4—4 of FIG. 1 showing a portion of the drive mechanism in greater detail.

Turning now to FIGS. 3 and 4, drive mechanism 42 comprises an overrunning clutch shown generally at 72. The clutch has an input drum 72*a* and a co-linear output drum 72*b*. The output drum includes an axial opening (not shown) for receiving the end of the fountain roller axle 26*a* projecting through bearing 27*a* (FIG. 4), the two being keyed together for rotation. Connected to the clutch input drum 72*a* is a fixed-length generally teardrop-shaped lever arm 74, the wide end of the lever arm being secured to the face of the clutch input drum 72*a* by a circular array of bolts 76 extending through appropriate openings in the lever arm and turned down into threaded openings in that drum. The smaller end of the lever arm 74 is connected by a pivot 78 to one end of a relatively long connecting rod 82, the other end of which is connected by a pivot 84 to an eccentric 86.

Eccentric 86 is mounted on a driven shaft 88 rotatively mounted via a bearing 92 in the press side wall 12. Shaft 88 is rotated clockwise in the direction indicated by the arrow in FIG. 3 by the prime mover of the press. Such rotation results in reciprocating movements of the connecting rod 82 and back and forth or oscillatory motion of the lever arm 74 as shown by the double-headed arrow in FIG. 3 and the angle A in FIG. 5A.

Clutch 72 is a so-called wrap-spring overrunning clutch whose structure and operation is described in detail, for example, in publication P-619 of Warner Electric Brake and Clutch Company entitled Wrap Spring Clutches and Brakes. Both its input and output drums 72*a* and 72*b* are encircled by a single fairly rightly wrapped coil spring 90 and the drums and spring encased are within a cylindrical clutch housing or sleeve 72*c*. Desirably one or more slots 92 are provided in the sleeve through which oil may be circulated to lubricate and cleanse the clutch.

When the input drum 72*a* is rotated in one direction, say, clockwise in FIG. 3, frictional engagement between it and the spring 90 winds up the spring so that it tightly engages both drums 72a and 72b with the result that torque is coupled between the input and output drums. On the other hand, when the input drum is rotated in the opposite direction, i.e. counterclockwise, the wrap of the spring about the input drum 72a is relaxed so that no torque is coupled between the input and output drums.

Also, the spring end 90a (FIG. 4) adjacent the input drum 72a is connected to the clutch sleeve 72c so that the spring and sleeve rotate together. Thus when the clutch input drum 72a is rotated in the drive direction, i.e. clockwise in this example, the clutch spring 90 and sleeve 72c will rotate along with the input and output drums. However, it is characteristic of wrap-spring clutches such as this that if rotation of the sleeve 72c is stopped, thereby stopping spring end 90a adjacent the input drum, the wrap of the spring 90 about the input and output drums loosens, thereby decoupling the clutch drums.

Still referring to FIGS. 3 and 4, in the present drive mechanism 42, a nose or protuberance 98 is formed at the end of sleeve 72c adjacent the press side wall 12. Also, a generally rectangular plate 102 is rotatively mounted between sleeve 72c and the press wall 12. Secured by screws 104 to the upper end of plate 102 is a stop 106 which projects laterally so that it overlies the clutch sleeve 72c. Thus when the clutch sleeve 72c is rotated clockwise, the nose 98 will eventually engage the stop 106 preventing further rotation of the sleeve and thereby decoupling the clutch as described above. The point at which the nose engages the stop depends upon the orientation of plate 102.

As shown in FIG. 3, the orientation of plate 102 is controlled by means of an adjusting screw 108 rotatively secured to the press wall 12 by a bracket 110 so that the threaded screw end 108a lies adjacent the lower end of plate 102. The screw end 108a is arranged and adapted to screw into a nut 112 connected by a pivot 114 to the lower end of plate 102. Mounted on the opposite end 108b of the adjusting screw is a conventional Tejax hand wheel 116 with the usual angle indicator. As best seen in FIG. 3, the hand wheel is located right at the edge of the press wall 12 so that it is readily accessible to the pressman.

As best seen in FIGS. 3 and 4, a second nose 118 is provided at the opposite end of sleeve 72c. Also a ring 122 encircles the clutch input drum 72a. The ring is set at a selected orientation relative to the drum 72a by a series of set screws 124 threaded into the ring and bearing against the drum 72a. Projecting laterally from ring 122 so as to overlie sleeve 72c is a pin 126. By properly orienting ring 122, the pin can be brought into engagement with the nose 118 as seen in FIG. 4. The ring setting is made when initially calibrating the Tejax hand wheel 116 as will be described later.

Figure 5A:
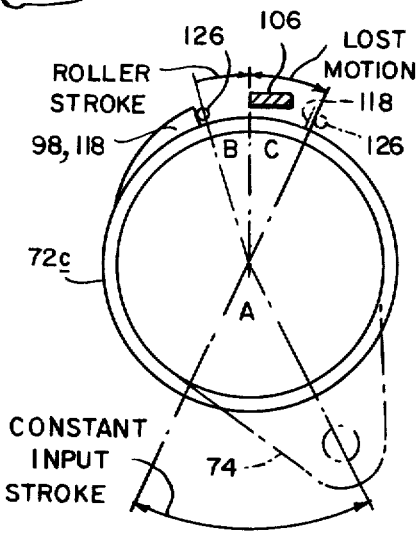
FIGS. 5A and 5B are diagrammatic views illustrating the operation of the drive mechanism.

Referring now to FIGS. 3 and 5A, during the operation of the drive mechanism 42, the eccentric 86 is rotated clockwise as shown in FIG. 3. This rotary motion is reflected as an oscillation of the lever arm 74 and the clutch input drum 72a through a constant input stroke or angle A shown in FIG. 5A. As described above, when the drum 72a is turned clockwise as viewed in FIGS. 3 and 5A, torque is coupled to the output drum 72b and thus to the fountain roller 26. Thus the roller stroke begins when eccentric 86 is in its top dead center position, i.e. when its pivot 84 is closest to clutch 72. In the usual overrunning clutch, the clutch input and output remain coupled and therefore the roller stroke continues until eccentric 86 reached its bottom dead center position after rotating 180°. In the present instance, however, the clutch input and ouput drums are decoupled when the nose 98 on sleeve 72c engages stop 106 as described above. Therefore, although the clutch input drum is turned through angle A by eccentric 86, the clutch output drum 72b and the fountain roller 26 may rotate through a lesser stroke angle B. Thus, as seen in FIG. 5A, the lever arm 74 may very well by swung through an angle A which is larger than the roller stroke angle E, the difference angle C representing the lost motion of the lever arm. The size of angle B is, of course, determined by the orientation of the stop plate 102 as set by the hand wheel 116. After eccentric 86 reaches its bottom dead center position, the lever arm 74 and clutch input drum 72a are rotated counterclockwise through angle A, during which motion the clutch input and output drums are decoupled as described above.

As the eccentric continues to rotate, the fountain roller 26 is rotated intermittently in a clockwise direction through a set stroke angle B. Each stroke commences when eccentric 86 is in its top dead center position and each stroke ends when nose 98 engages stop 106. The length of each fountain roller stroke depends upon the phase difference between eccentric 86 and stop plate 102. For example, if the orientation of plate 102 is set so that nose 98 engages stop 106 when eccentric 86 is in its top dead center position, further rotation of the eccentric will immediately cause the clutch to decouple so that the fountain roller 26 will not move at all. On the other hand, if plate 102 is adjusted so that the phase difference between the eccentric and the plate is 45°, then rotation of the eccentric will cause the fountain roller 26 to rotate through 45° before nose 98 engages stop 106 thereby decoupling the clutch. The clutch input drum 72a will of course turn through angle A as it always does.

Thus by properly setting the hand wheel 116, the stroke of the fountain roller can be set precisely at the desired angle. The clutch input and output drums are very closely coupled so that a typical clutch of this type has a slip angle as low as 2 to 4 degrees. However, the slip is substantially constant so that it can be compensated for easily when calibrating the mechanism as will be described presently.

Figure 5B:
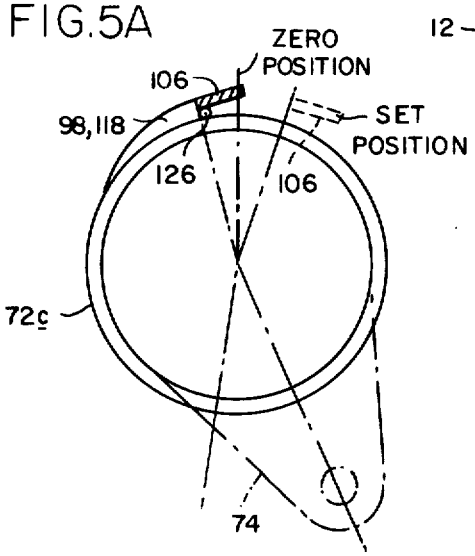

Referring now to FIGS. 3 and 5B, to calibrate the drive mechanism 42, eccentric 86 is set to its top dead center position bringing lever arm 74 to its right-most position as shown in FIG. 5B which determines the start of the roller indexing stroke. Then the hand wheel 116 is turned until the stop 106 engages nose 98 as shown in solid lines in that figure thus giving the fountain roller 26 a stroke angle of zero degrees. Next, the set screws 124 are loosened permitting ring 122 to be turned on clutch drum 72a until pin 126 engages nose 118 as shown in FIG. 5A. Finally the Tejax indicator on hand wheel 116 is set to the zero angle position. At this point, the angle indication on the indicator 116 coincides with the stroke angle of the fountain roller 26. Now the hand wheel 116 can be turned until the desired stroke angle B appears on the indicator moving stop 106 to a set position shown in dotted lines in FIG. 5B with assurance that when the drive mechanism is in operation, the fountain roller 26 will advance intermittently precisely through that selected stroke angle B.

Using my fountain drive mechanism, then, the amount of ink coated onto the fountain roller 26 can be controlled very closely to optimize the printing process. While sprag type one way clutches have been used in fountain drive mechanisms before, these all required variable length lever arms to drive the clutch, considerably increasing the cost and complexity of those prior drive mechanisms. No one, to applicant's knowledge, has ever thought to use a constant length eccentric drive to oscillate a wrap-spring clutch and include provision for correlating the phase angle between the driving eccentric and an adjustable stop to decouple that clutch in order to precisely define the stroke angle of the fountain roller, even though achieving precise roller stroke control has been a problem that has plagued the press industry for many years.

It will thus be seen that the objects set forth above are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described.

I claim:

1. In an ink fountain of the type having a rotatively mounted fountain roller, a roller drive mechanism comprising:

A. a wrap spring overrunning clutch having an input drum, an output drum, a concentric sleeve encircling both drums, and a coil spring grippingly encircling the drums within the sleeve, said spring having its end adjacent the input drum secured to the sleeve, B. means for connecting the roller for rotation with the output drum, C. means for oscillating the clutch input drum through a selected angle, the oscillating input drum movement in one direction causing tightening of said spring about the input and output drums right at the start of each oscillation whereby the clutch output drum and sleeve, as well as the fountain roller are rotated in said direction commencing right at the start of each oscillation, D. means for positively stopping the rotation of the clutch sleeve after the sleeve has rotated through a desired stroke angle so as to loosen the spring windup and thereby decouple the input and output drums and thereby terminate the angular advance of the output drum and the fountain roller in said direction while said input drum completes its rotation through said selected angle, and E. coacting means on the clutch input drum and sleeve for positively rotating the sleeve in the opposite direction back to its initial position at the start of each said oscillation.

2. The ink fountain defined in claim 1 wherein the oscillating means comprises:

A. a rod;

B. means for pivotally connecting one end of the rod to the clutch input drum at a location away from its axis of rotation, and C. means for reciprocating the rod so as to oscillate the input drum.

3. The ink fountain defined in claim 2 wherein the reciprocating means comprises:

A. an eccentric, and

B. means for pivotally connecting the other end of the rod to the eccentric.

4. The ink fountain defined in claim 2 wherein the connecting means comprises a lever arm secured to the clutch input drum and wherein the pivot is located near the end of the lever arm.

5. The ink fountain defined in claim 1 and further including means for adjusting the stopping means so as to alter the point at which the stopping means stops the clutch sleeve thereby to change the angle through which the fountain roller is rotated during each oscillation of the clutch input drum.

6. The ink fountain defined in claim 5 wherein the stopping means comprises a stop plate movably positioned adjacent the clutch, a portion of the clutch sleeve being arranged to engage a portion of the stop plate before the clutch sleeve has rotated through an angle greater than about 180°.

7. The ink fountain defined in claim 6 wherein the adjusting means comprises means for moving the stop plate angularly relative to the sleeve portion so as to adjust the angle through which the clutch sleeve rotates before the sleeve portion engages the stop plate portion.

8. The ink fountain defined in claim 6 wherein

A. the stop plate is rotatively mounted substantially coaxially with the clutch axis, and B. the adjusting means comprises means for rotating the stop plate relative to the clutch sleeve.

9. The ink fountain defined in claim 8 wherein the rotating means for the stop plate comprises:

A. threaded connecting means pivotally mounted to the stop plate,

B. a screw having one end screwed into the connecting means, and

C. means spaced from the stop plate for anchoring the screw against axial movement but permitting its rotation whereby rotation of the screw in one direction or the other rotates the stop plate in one direction or the other about the clutch axis.

10. In an ink fountain of the type having a rotatively mounted fountain roller, a roller drive mechanism comprising:

A. a wrap spring overrunning clutch having an input drum, an output drum, a concentric sleeve encircling both drums, and a coil spring grippingly encircling the drums within the sleeve, said spring having its end adjacent the input drum secured to the sleeve, B. means for connecting the roller for rotation with the output drum, C. means for oscillating the clutch input drum through a selected angle, the oscillating input drum movement in one direction causing tightening of said spring about the input and output drums right at the start of each oscillation whereby the clutch output drum and sleeve, as well as the fountain roller are rotated in said direction commencing right at the start of each oscillation, D. means for positively stopping the rotation of the clutch sleeve after the sleeve has rotated through a desired stroke angle so as to loosen the spring windup and thereby decouple the input and output drums and thereby terminate the angular advance of the output drum and the fountain roller in said direction before said input drum completes its rotation through said selected angle, E. means for adjusting the stopping means so as to alter the point at which the stopping means stops the clutch sleeve thereby to change the angle through which the fountain roller is rotated during each oscillation of the clutch input drum, and F. means for calibrating the adjusting means to the stroke angle of the fountain roller, wherein the calibrating means includes means on the sleeve and input drum which engage one another to prevent relative rotation of the clutch input drum and the clutch sleeve in the driving direction when the clutch input drum is positioned at the beginning of its driving stroke.

11. The ink fountain defined in claim 5 and further including means for calibrating the adjusting means to the stroke angle of the fountain roller.

12. The ink fountain defined in claim 11 wherein the engaging means includes A. a ring engaged about the input drum, B. means projecting from the ring toward the clutch sleeve, C. means on the sleeve for engaging the projecting means during the driving stroke of the input drum, and D. means for adjustably fixing the angular position of the ring on the input drum.

* * * * *